US006125722A

United States Patent [19]

Hopper, Jr. et al.

[11] Patent Number: 6,125,722

[45] Date of Patent: Oct. 3, 2000

[54] RATCHET WRENCH WITH SEALED REVERSING LEVER

[75] Inventors: Richard L. Hopper, Jr., Kenosha; William A. Nurmi, Racine; Charles H. Heiligenthal, Kenosha, all of Wis.; Kenneth E. Kessler, Albion, Ill.

[73] Assignee: Snap-on Tools Company, Kenosha, Wis.

[21] Appl. No.: 09/271,968

[22] Filed: Mar. 18, 1999

[51] Int. Cl.[7] ..... B25B 13/46

[52] U.S. Cl. ..... 81/63; 81/62; 81/63.1

[58] Field of Search ..... 81/62, 63, 63.1, 81/63.2

[56] References Cited

U.S. PATENT DOCUMENTS

| | | | |
|---|---|---|---|
| 2,957,377 | 10/1960 | Hare | 81/63 |
| 2,981,389 | 4/1961 | Kilness . | |
| 3,362,267 | 1/1968 | Rozmus . | |
| 4,318,314 | 3/1982 | Furedi et al. . | |
| 4,448,095 | 5/1984 | Blodgett et al. . | |
| 4,770,071 | 9/1988 | Steier . | |
| 4,905,548 | 3/1990 | Colace et al. . | |
| 4,934,220 | 6/1990 | Slusar et al. . | |
| 5,157,994 | 10/1992 | Krivec | 81/63.2 |
| 5,495,783 | 3/1996 | Slusar et al. . | |
| 5,509,331 | 4/1996 | Nickipuck . | |
| 5,586,751 | 12/1996 | Ueno et al. . | |
| 5,921,158 | 7/1999 | Slusar et al. | 81/63 |

*Primary Examiner*—David A. Scherbel
*Assistant Examiner*—Lee Wilson
*Attorney, Agent, or Firm*—Seyfarth Shaw

[57] ABSTRACT

A reversible ratchet wrench has a ratchet body with a cavity receiving the ratchet assembly. A pawl-engaging reversing lever is insertable through an opening in the ratchet body from the cavity and has a flange dimensioned to be trapped between the body and the pawl. A seal between the reversing lever and the ratchet body is provided by an O-ring seated in a groove in the outer surface of the reversing lever hub. A cover plate closes the cavity and cooperates with the pawl and the flange to retain the reversing lever in place.

16 Claims, 1 Drawing Sheet

RATCHET WRENCH WITH SEALED REVERSING LEVER

BACKGROUND OF THE INVENTION

The present invention relates to ratchet devices and, in particular, to ratchet wrenches of the reversible type having a manually-operated reversing member. The invention relates in particular to seals for the reversing member.

The present invention is an improvement of the reversible ratchet wrench disclosed in U.S. Pat. No. 4,934,220. In that wrench a wrench body has a generally pear-shaped ratchet head with a cavity formed in one side thereof for accommodating the ratchet assembly, which includes a ratchet gear and a spring-biased pawl engageable with the gear in forward, reverse and non-ratcheting positions for controlling the mode and direction of operation of the ratchet mechanism. The operating position of the pawl is controlled by a reversing member which has hub or stem extending though an opening in the ratchet head and into a hollow neck portion of the pawl which projects up into the opening, being secured to the pawl with a suitable fastener. An annular lip seal is provided between the ratchet head and the neck portion of the pawl. The cavity is closed by a cover plate retained in place by screws and provided with appropriate seals. The apparatus works well, but requires the use of a separate fastener to retain the reversing member and is relatively complicated and difficult to disassemble for purposes of replacement of the pawl seal.

Other types of ratchet assemblies have been provided with seals between a reversing member and a ratchet head, but they have utilized more complex ratchet mechanisms.

SUMMARY OF THE INVENTION

It is a general object of the invention to provide an improved reversible ratchet device which avoids the disadvantages of prior devices while affording additional structural and operating advantages.

An important feature of the invention is the provision of a reversible ratchet device with an improved seal for the reversing member.

In connection with the foregoing feature, another feature of the invention is the provision of a reversible ratchet device of the type set forth, which is of relatively simple and economical construction and is relatively easy to assemble and disassemble.

Certain ones of these and other features of the invention may be attained by providing a sealed reversible ratchet device comprising: a ratchet body having a cavity therein and an opening communicating with the cavity, a ratchet assembly disposed in the cavity and including a ratchet gear and a pawl mechanism having at least one pawl, a reversing lever directly engaged with the at least one pawl and projecting outwardly through the opening, and a seal between the reversing lever and the ratchet body.

Other features of the invention may be attained by providing a ratchet device of the type set forth, wherein the reversing lever has a head portion projecting outwardly through the opening and a flange engageable with the ratchet body in the cavity and dimensioned to prevent passage through the opening, and a cover plate attachable to the ratchet body for closing the cavity and cooperating with the flange to retain the reversing lever in the cavity.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
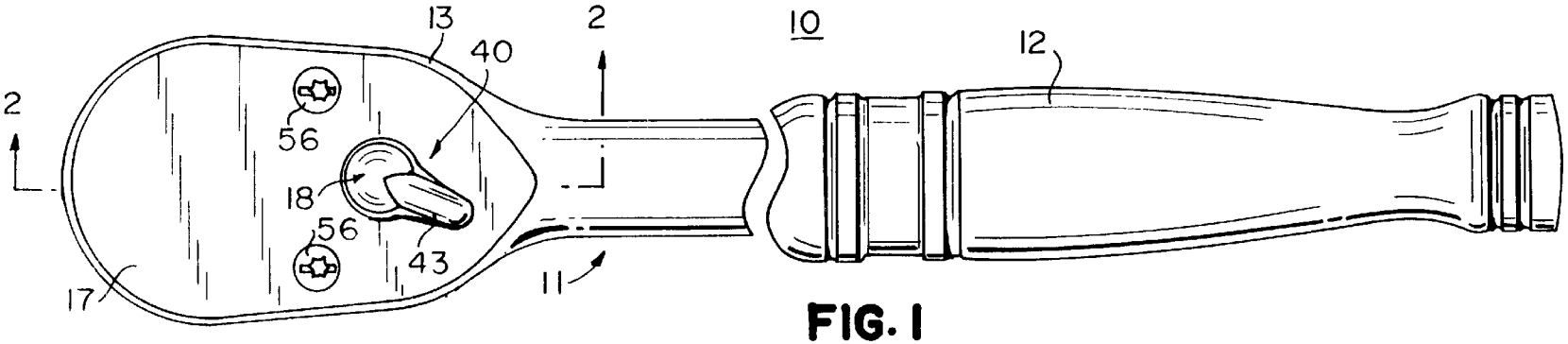
FIG. 1 is a top plan view of a reversible ratchet wrench in accordance with the present invention, with a portion of the handle removed.

Referring to the drawings, there is illustrated a reversible ratchet device in accordance with the present invention in the nature of a ratchet wrench 10 having a unitary, one-piece ratchet body 11 including an elongated handle portion 12 and an oblong, generally "pear shaped" head portion 13. The head portion 13 has a lower side 14 in which is formed an enlarged cavity 15, around the periphery of which is formed a surrounding countersink recess 16. The head portion 13 has an upper side 17 in which is formed a relatively small circular opening 18 which communicates with the cavity 15, being surrounded at its cavity end by en enlarged-diameter counterbore recess 19.

Figure 2:
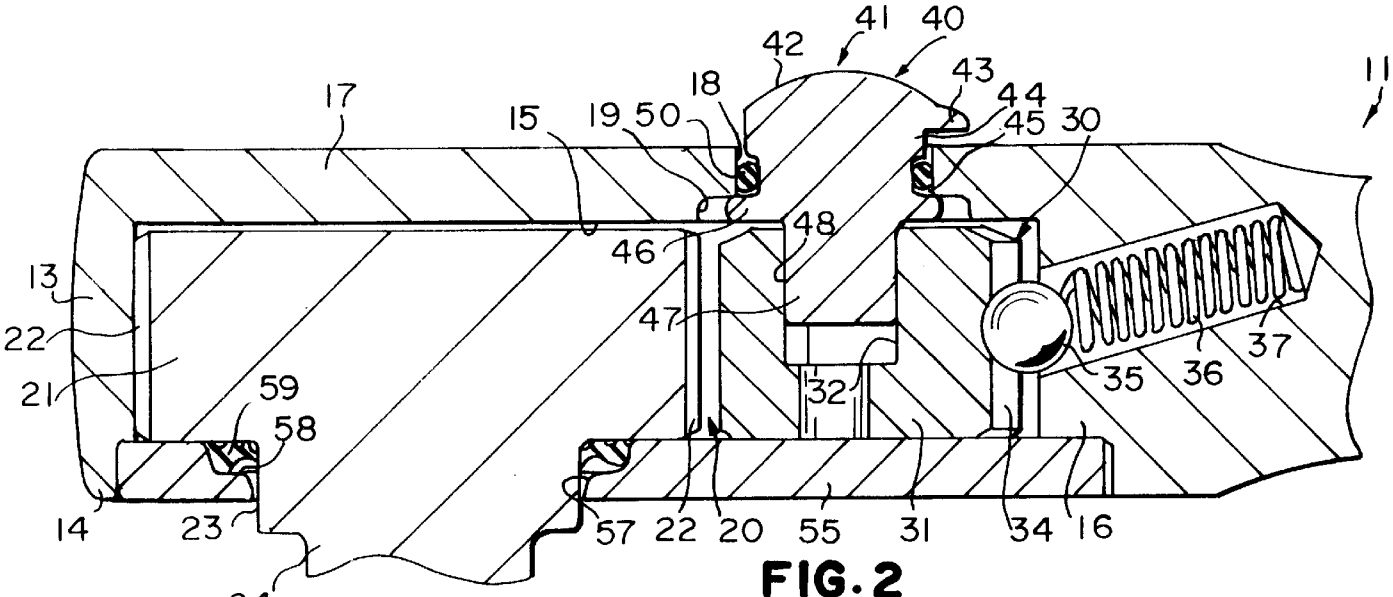
FIG. 2 is an enlarged, fragmentary view in vertical section taken generally along the line 2—2 in FIG. 1.
Figure 3:
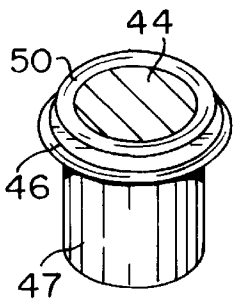
FIG. 3 is a perspective view of the reversing lever of the ratchet wrench of FIG. 2 and a seal ring therefor, with an upper portion of the reversing lever removed.

Disposed in the cavity 15 is a ratchet assembly 20 which is substantially similar to that disclosed in the aforementioned U.S. Pat. No. 4,934,220. The ratchet assembly 10 includes a ratchet gear 21 having teeth 22 and a reduced-diameter hub 23 from which projects a drive lug 24 for engagement with an associated driven member, all in a known manner. The ratchet assembly 20 also includes a pawl mechanism 30, including a double-ended pawl 31 having two sets of pawl teeth (not shown) respectively at its opposite ends for selective engagement with the ratchet gear 21. Formed in the upper surface of the pawl 31, as viewed in FIG. 2, is a socket 32 which is of non-circular transverse cross section, preferably having a flat along the front side thereof. The rear end of the pawl 31 has engagement projections 34 (one shown) for engagement with a detent ball 35, biased into engagement with the pawl 31 by a helical compression spring 36 seated in an inclined bore 37 in the wrench body 11, again all in a known manner. The pawl 31 is adapted for pivoting movement about the axis of the socket 32 among three different operating positions, viz., a forward ratcheting position in which one set of pawl teeth is engaged with the ratchet gear 21, a reverse ratcheting position in which the other set of pawl teeth is engaged with the ratchet gear 21, and a neutral or non-ratcheting position in which neither set of pawl teeth is engaged with the ratchet gear 21, again all in a known manner. The pawl 31 is resiliently retained in each of its selected positions by the biased ball 35.

Shifting of the pawl 31 among its operating positions is effected by a reversing lever 40. The reversing lever 40 is a generally L-shaped member, having a head portion 41 with an arcuate or rounded top surface 42. The head portion 41 includes a lever or handle arm 43 projecting laterally therefrom and a substantially cylindrical hub 44 with an axis which is disposed substantially perpendicular to the longitudinal axis of the lever arm 43. The hub 44 is provided with an annular groove 45 in its outer surface and with a radially outwardly extending annular flange 46 adjacent to the groove 45. Depending from the hub 44, substantially coaxially therewith, is a stem 47 which may be substantially part-cylindrical in shape with a flat 48 formed on one side thereof, the stem 47 being dimensioned and shaped for mating engagement in the socket 32 of the pawl 31. An O-ring seal 50 is seated in the groove 45.

In assembly, the reversing lever 40 is mounted from the cavity side of the wrench head portion 13. The lever arm 43 is pushed up through the opening 18, then the reversing lever 40 is tilted to bring the hub 44 into the opening 18 coaxially therewith with the lever arm 43 extending along the outside of the body 11, the rounded top surface 42 of the head portion 41 providing adequate clearance to permit this tilting movement. The flange 46 on the reversing lever 40 is dimensioned to seat in the recess 19 and engage the head portion 13 around the periphery of the opening 18 to prevent passage through the opening 18. In this mounted position, illustrated in FIG. 2, the O-ring seal 50 is disposed in sealing engagement with the cylindrical surface defining the opening 18 and with the cylindrical surface defining the bottom of the groove 45 to effectively seal the opening 18 around the reversing lever hub 44. This effectively inhibits lubricating fluid and the like from exiting the cavity 15 and inhibits dirt and other foreign particles from entering the cavity 15 through the opening 18.

Once the reversing lever has been disposed in its mounted position, the spring 36 and ball 35 are mounted in place and then the pawl 31 is fitted in place over the stem 47 of the reversing lever 40 and the ratchet gear 21 is then mounted in place. The parts of the ratchet assembly 20 are retained in place by a cover plate 55, which seats in the recess 16 so that its outer surface is substantially flush with the lower side 14 of the head portion 13, as illustrated in FIG. 2. The fit of the cover plate 55 and the countersink recess 16 creates a seal around the cover plate that effectively inhibits lubricating fluid and the like from exiting the cavity 15 and inhibits dirt and foreign particles from entering the cavity 15 between the cover plate 55 and the recess 16. The cover plate 55 is secured in place by screws 56 (FIG. 1) passing through apertures (not shown) in the upper side 17 of the head portion 13. The cover plate 55 has a circular hole 56 therethrough for receiving the hub 23 of the ratchet gear 21, the hole 57 being surrounded by an annular counterbore recess 58 on the inner surface of the cover plate 55 for receiving a lip seal 59 to provide a seal between the cover plate 55 and the ratchet gear 21.

The depth of the pawl 31 is such that, when the cover plate 55 is thus mounted in place, the reversing level flange 46 is effectively trapped between the pawl 31 and the head portion recess 19 to limit axial movement of the reversing lever 40. Thus, it will be appreciated that the reversing lever 40 is effectively retained in place without the use of any additional fasteners. The reversing lever 40 is keyed to the pawl 31 so that the pawl 31 rotates in direct response to rotation of the reversing lever 40. Preferably, the O-ring seal 50 is formed of rubber or a suitable elastomer.

From the foregoing, it can be seen that there has been provided an improved reversible ratchet assembly and reversing member seal therefor, which is of relatively simple and economical construction, provides an improved seal for the reversing member, and which is mounted without the use of an additional fastener to facilitate seal replacement.

While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A reversible ratchet device comprising:

a ratchet body having a cavity therein and an opening communicating with the cavity, a ratchet assembly disposed in the cavity and including a ratchet gear and a pawl mechanism having at least one pawl, a reversing lever coupled to the pawl mechanism and having a head portion projecting outwardly through the opening and an annular flange engageable with the ratchet body in the cavity and dimensioned to prevent passage through the opening, and a cover plate attachable to the ratchet body for closing the cavity and cooperating with the flange to retain the reversing lever in the cavity.

2. The ratchet device of claim 1, wherein said pawl mechanism includes only a single pawl pivotally movable about a pivot axis, said reversing lever being rotatable about an axis coaxial with said pivot axis.

3. The ratchet device of claim 1, wherein said device is a wrench, said ratchet body including a handle portion and a head portion having the cavity therein.

4. The ratchet device of claim 1, wherein said flange engages said ratchet body around the periphery of said opening.

5. The ratchet device of claim 4, wherein said ratchet body has an annular recess in an inner surface thereof for receiving said flange.

6. The ratchet device of claim 4, wherein said flange is disposed between said ratchet body and said at least one pawl for engagement with each to limit movement of the reversing lever axially of the opening.

7. The ratchet device of claim 1, wherein said reversing lever includes a stem projecting from said head portion inwardly of said cavity for engagement with said at least one pawl, said head portion including a hub disposed in use coaxially through the opening and a handle disposed in use along the outside of the ratchet body and extending laterally from the hub.

8. The ratchet device of claim 7, wherein said hub has an annular groove in an outer surface thereof, said seal including an O-ring seated in said groove.

9. The ratchet device of claim 7, wherein said head portion has an upper surface curved to provide clearance to facilitate insertion of the reversing lever in the opening from the cavity.

10. A sealed reversible ratchet device comprising:

a ratchet body having a cavity therein and an opening communicating with the cavity, a ratchet assembly disposed in the cavity and including a ratchet gear and a pawl mechanism having at least one pawl, a reversing lever coupled to the pawl mechanism and having a head portion projecting outwardly through the opening and an annular flange engageable with the ratchet body in the cavity and dimensioned to prevent passage through the opening, a seal between the head portion of the reversing lever and the ratchet body, and a cover plate attachable to the ratchet body for closing the cavity and cooperating with the flange to retain the reversing lever in the cavity.

11. The ratchet device of claim 10, wherein said ratchet body and said reversing lever respectively have concentric cylindrical surfaces, said seal being disposed between said cylindrical surfaces.

12. The ratchet device of claim 11, wherein said seal is a O-ring.

13. The ratchet device of claim 12, wherein the cylindrical surface on said reversing lever is the bottom of an annular groove in which the O-ring is seated.

14. The ratchet device of claim 10, wherein the device is a wrench, said ratchet body including a handle portion and a head portion in which the cavity is formed.

15. The ratchet device of claim 10, wherein said reversing lever includes a stem projecting from said head portion inwardly of said cavity for engagement with said at least one pawl, said head portion including a hub disposed in use coaxially through the opening and a handle disposed in use along the outside of the ratchet body and extending laterally from the hub.

16. The ratchet device of claim 15, wherein said head portion has an upper surface curved to provide clearance to facilitate insertion of the reversing lever in the opening from the cavity.

* * * * *